United States Patent [19]

Thomas

[11] 4,281,829

[45] Aug. 4, 1981

[54] METHOD AND APPARATUS FOR EJECTING SINGLE SHEETS FROM A STACK OF SHEETS IN A TRAY

[76] Inventor: Wilbur E. Thomas, 165 Hillcrest Dr., Wayne, N.J. 07470

[21] Appl. No.: 107,549

[22] Filed: Dec. 27, 1979

[51] Int. Cl.[3] ..... B65H 3/30

[52] U.S. Cl. ..... 271/10; 271/19

[58] Field of Search ..... 271/10, 16, 19, 20–25

[56] References Cited

U.S. PATENT DOCUMENTS

| | | | |
|---|---|---|---|
| 1,648,115 | 11/1927 | Dickman | 271/19 |
| 2,795,419 | 6/1957 | Ritzerfeld | 271/19 |
| 3,627,307 | 12/1971 | Van der Does | 271/19 X |

*Primary Examiner*—Richard A. Schacher
*Attorney, Agent, or Firm*—Norman N. Popper

[57] ABSTRACT

A method and apparatus for discharging sheets one by one from a stack wherein a reciprocating ejector foot engages the top sheet of the stack and urges it against barriers positioned to intercept the corners of the sheet; the barriers are disposed obliquely to the plane defined by the sheet thereby tending to block the corners of the sheet from moving out of the tray but permitting the portion of the sheet between the corners to buckle upwardly and enter the nip of a pair of rollers, raising the corners of the sheet from engagement with the oblique corner barriers and pulling it from the tray.

4 Claims, 5 Drawing Figures

METHOD AND APPARATUS FOR EJECTING SINGLE SHEETS FROM A STACK OF SHEETS IN A TRAY

BACKGROUND OF THE INVENTION

1. FIELD OF THE INVENTION

This invention relates to apparatus and means for ejecting a single sheet from a stack of sheets in a tray and particularly to methods and apparatus wherein sheets are ejected singly to be collated with other sheets ejected singly.

2. PRIOR ART

The collator art of highly developed and numerous methods and means have been devised to ensure that when the active collation proceeds, only one sheet from a stack of identical sheets is ejected from a tray to be collated with other sheets. Unfortunately, it is frequent that several sheets rather than one are ejected from a tray simultaneously. It also occurs that instead of a single sheet being ejected from a stack of sheets in a tray, the active ejection of a single sheet fails altogether and the collated groups of different sheets has one or more missing sheets. It is believed that the ejection of a single sheet from a stack of sheets in a tray is defeated at times by the fact that superposed sheets in juxtaposition with each other adhere to each other because of a vacuum between them so that any ejection method or device should accomplish the breaking of the interface vacuum between the sheets. A single sheet feeding device, aside from use in collators, is useful for non-collating devices where a single sheet is fed, e.g. duplicators, copiers, etc.

SUMMARY OF THE INVENTION

It has been found that an edge barrier disposed at an acute angle to the tray and to the sheets in the tray will accomplish ejection of a single sheet. By this construction, the front edge of the sheet in the tray has no tendency to rise over the surface of the barrier. Rather, the front edge of the sheet tends to be deflected against the barrier in a downward direction and the succeeding portion of the sheet tends to billow upwardly breaking the interface vacuum. Also, the middle of the front edge of the sheet, which is unrestrained at the corner acute barriers, projects from the tray outwardly. It there encounters a pair of rollers, enters the nip of the rollers and is pulled from the tray. The corners of the sheet are lifted and released from the corner barriers by this pulling action. The vacuum at the interface of the sheets is broken, and the top sheet is ejected from the tray. In this method and device, a high degree of assurance prevails that only a single sheet at a time is moved off of the stack of sheets in the tray and ejected from the tray, thereupon being collated with other sheets similarly ejected from their trays. Aside from singulation, this method and apparatus is highly resistent to skips, meaning those occurrences where no sheet at all is ejected from the stack of sheets in the tray.

THE DRAWINGS

These objects and advantages as well as other objects and advantages may be obtained by the device shown by way of illustration in the drawings in which.

PREFERRED EMBODIMENT

Figure 1:
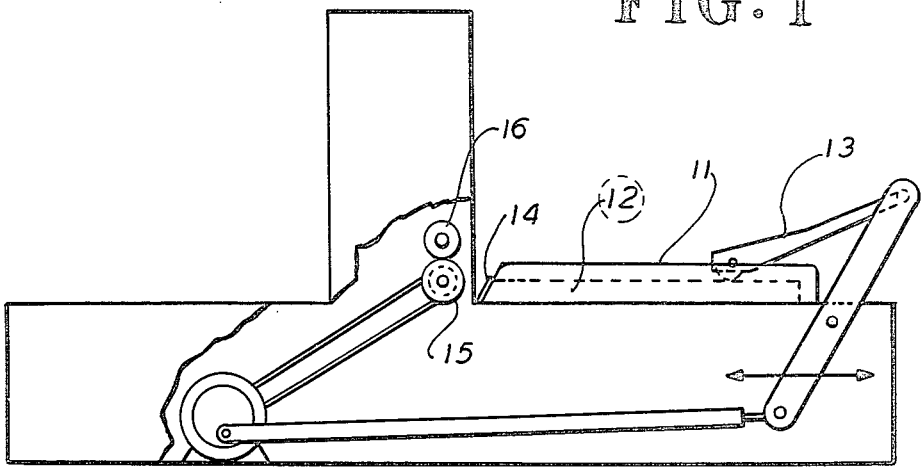
FIG. 1 is a side elevational view of the ejector, with partially exploded walls to show a typical drive.
Figure 2:
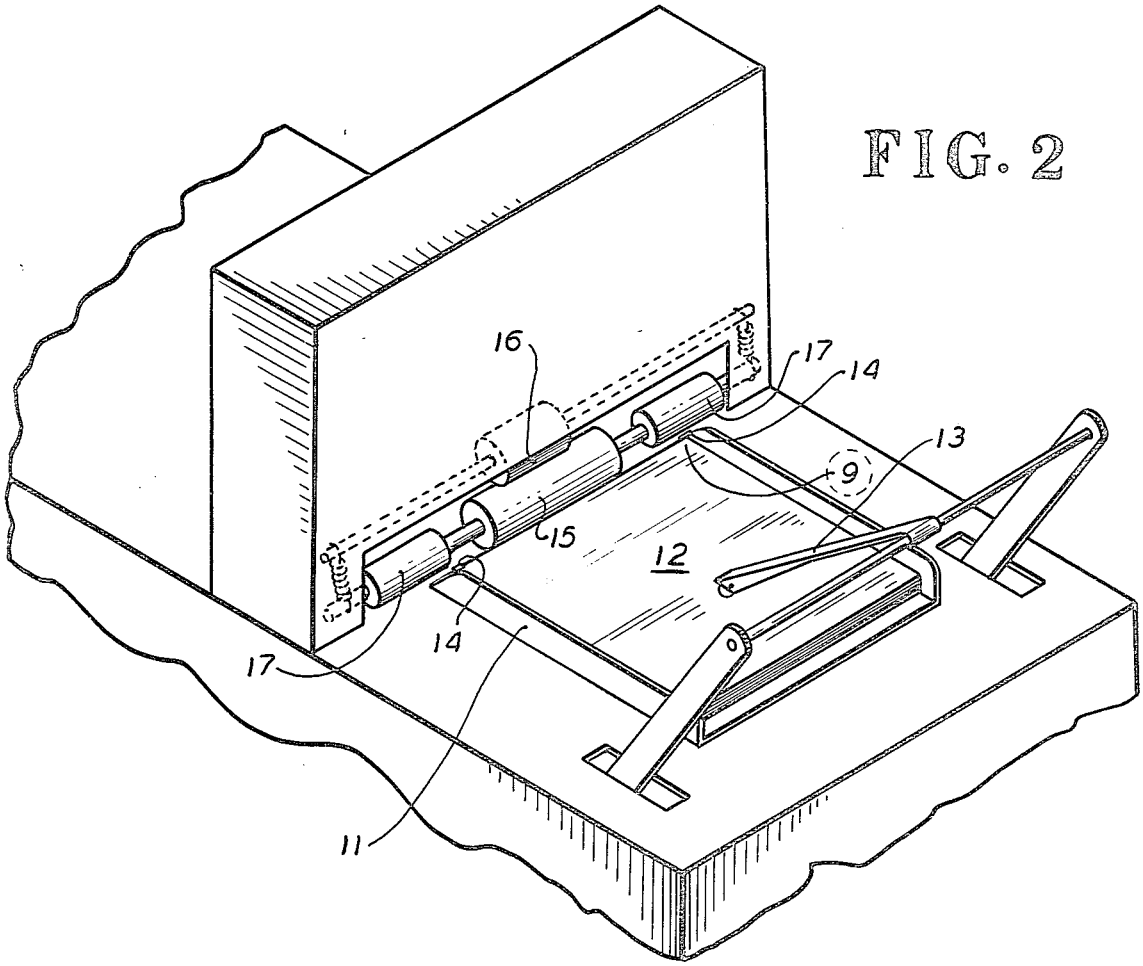
FIG. 2 is a top rear view of the ejector.
Figure 3:
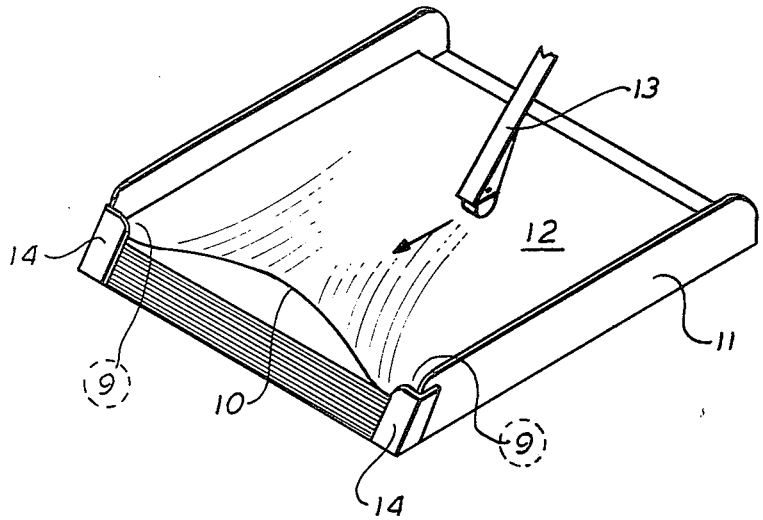
FIG. 3 is a perspective view of the ejection end of the tray.

Referring now to the drawings in detail, it is to be understood that the single tray shown is merely intended to illustrate the method and apparatus for ejecting a single sheet from a stack of sheets in a tray, and that in other usage, there may be a plurality of superposed trays from which one sheet at a time is ejected to be collated with a sheet ejected from each of the other trays, in a single stack in a single receiving tray.

Figure 4:
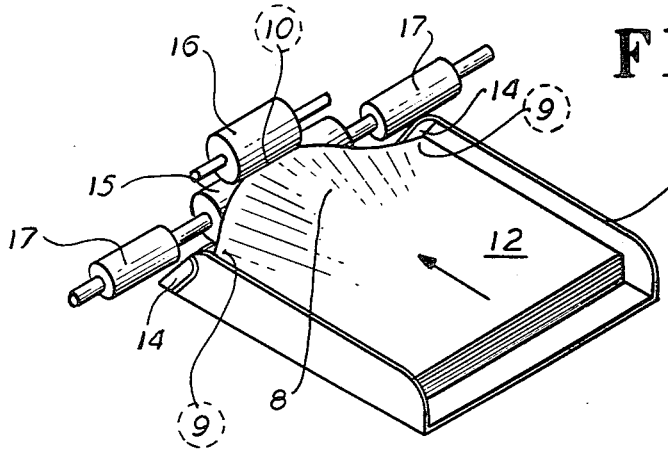
FIG. 4 is a perspective view of the side of the tray showing the top sheet billowed at the center and the side edges captured by the barriers.
Figure 5:
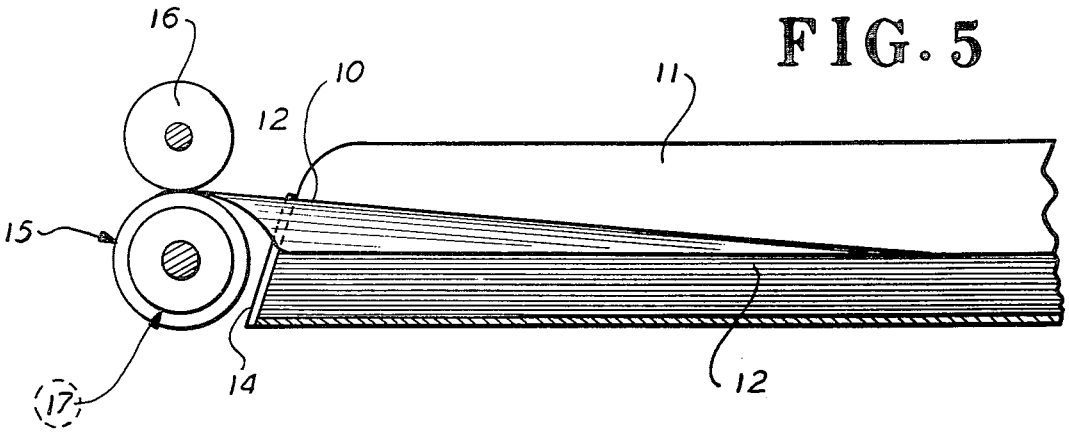
FIG. 5 is a side elevational view of the top sheet's leading edge at the center entering the nip of the rollers.

There is provided a tray 11, onto which a stack of sheets 12 is deposited. An ejection foot 13, such as any of the paper ejectors now in use, is mounted over the tray for reciprocation and engagement with a stack of the sheets 12 so as to move them out of the tray 11 one by one. The corners of the tray 11, at the point where the sheets move out of the tray is provided with narrow barriers 14 which rise from the floor of the tray and extend toward the top of the tray sufficiently to engage a portion of the end 9 of the leading edge of the top sheet 12 and block it from immediate discharge from the tray 11. These corner barriers 14, 14 are not perpendicular to the floor of the tray 11 but rise obliquely at an acute angle over the floor of the tray and over the plane defined by the stack of sheets 12. Thus as the ejector 13 moves to eject a sheet 12 from the tray 11, the corners of the sheet 12 are captured by the barriers 14. Since the barriers 14 are disposed at an acute angle to the plane of the sheets 12, the sheet 12 tends to curl downwardly at its front edge at the barriers 14, 14 but it cannot do so by reason of the underlying sheets in the stack in the tray. By reason of the acute angle of the corner barriers 14, the leading edge of the sheet 12, and particularly the corners thereof cannot curl upwardly. Thus a moment of force on the sheet is created which causes portions of the center of the sheet 12 immediately behind the leading edge 10 to billow upwardly. Beside that, the force exerted by the ejector 13 pushes the middle of the front edge 10 of the sheet outwardly from the tray 11, while the corners 9, 9 of the sheet 12 are still held by the barriers 14. As the front edge of the sheet, beyond the corner barriers 14, moves outwardly from the tray 11 and the portion of the sheet directly behind the front edge 10 billows upwardly, the front edge 10 of the sheet moves forward out of the tray 11 as shown in FIG. 4, where it encounters a roller 15. There is a means to drive this roller which may be the same means which causes the reciprocation of the ejector 13. This roller 15 is disposed in closely spaced relationship to the tray so that it will encounter the leading edge of the sheet 12. A spring loaded roller 16 immediately above the roller 15, is in contact with the roller 15 and the front edge of the sheet 12 enters the nip of these rollers 15, 16 and is pulled from the tray 11. When this takes place, the front edge 10 of the sheet 12 is drawn between the rollers 15, 16, pulling the corners 9, 9 of the sheet 12 from behind the corner barriers 14, and permitting the entire sheet to be pulled from the tray 11 and to be ejected as a single sheet.

This apparatus accomplishes the ejection of a single sheet 12 from the tray, and it is highly resistent: to missing single sheet ejection, or ejection of double sheets. The step of pushing the sheets 12 against the acute side barriers 14 creates a moment of force which tends to block and to deflect the corners of the leading edge of the sheet 12 in a downward direction, and to buckle the sheet upwardly to form a billow 8 succeeding the leading edge of the sheet, to break the vacuum between the top sheet and the successive underlying sheet so that it is released, the top sheet from the bottom sheet. While the sheet 12 being ejected is still engaged at its side edges with the corner barriers 14, 14, the ejector 13 is still urging the sheet forward, so that the middle of the leading edge 10 of the top sheet, by this means, is advanced while the corners of the sheet 12 are still detained or captured by the acute barrier 14. In this manner, the interface vacuum between the sheets 12 is broken. The rotating rollers 15, 16 in advance of the leading edge of the sheet 12 acquire the center of the leading edge of the top sheet 12 and seize the sheet 12 in the nip of the rollers 15, 16 to pull the corners of the sheet out of entrapment with the barriers 14. The corners are disengaged and the sheet is pushed from the tray by the continued action of the ejector 13, and the sheet is pulled out of the tray 11 by the rollers 15, 16. The side edges of the sheet 12 are disengaged from the barriers 14, 14. The side edges 9 encounter the side rollers 17, 17, and the sheet is propelled out of the tray 11.

What is claimed is:

1. A method for ejecting single sheets from a stack of sheets in a tray comprising, (a) stacking sheets in a tray, (b) providing front barriers on the opposite sides of the tray, (c) disposing the barriers over the tray acutely to the plane defined by the tray, (d) pushing an ejector foot over the top sheet of the stack of sheets in the tray to move the sheet toward the acute barrier, (e) blocking the leading edge of the top sheet at the side thereof with the acute barrier, (f) buckling the portion of the sheet behind the leading edge to billow upwardly, to break the vacuum interface between the top sheet and the underlying sheet, releasing the one from the other, (g) continuing to push on the top sheet, while the edges are engaged with the barrier, to extend the central portion of the top sheet at its leading edge, so that it advances beyond the corners of the sheet blocked by the acute barrier, (h) driving a pair of rollers positioned to seize the middle of the leading edge of the sheet in their nip, (i) pulling the middle of the leading edge of the sheet by the rotating rollers, to draw the corners of the leading edge of the sheet from entrapment behind the barriers, (j) continuing to push the sheet from the tray, and pull it by the rollers, from out of the tray to eject it singly from the tray.

2. The method for ejecting single sheets from a stack in a tray according to claim 1, and, (a) rotating generally coaxially rollers adjacent to the pair of rollers at each side thereof, to intercept the side edges of the leading edge of the sheet and direct the sheet out of the tray.

3. An apparatus for ejecting single sheets from a stack of sheets in a tray comprising, (a) a tray adapted to hold a stack of sheets, (b) a reciprocating ejector foot above the tray in engagement with the top sheet of a stack of sheets being pushed from the tray, (c) corner barriers on the tray extending acutely upwardly over the tray at its front edge, (d) a pair of driven rollers at the front edge of the tray, (e) the rollers disposed in intercepting relationship to a sheet ejected from the tray, (f) means to drive the rollers and to reciprocate the ejector foot, (g) the rollers disposed in spaced relationship to the stack of sheets in the tray, in position to seize the central portion of a sheet being pushed from the tray.

4. An apparatus for ejecting single sheets from a stack of sheets in a tray according to claim 3 comprising, (a) a auxiliary coaxial driven rollers on each side of the driven rollers to guide the corners of a sheet ejected from the tray.

* * * * *